US008708743B2

(12) United States Patent
Perello et al.

(10) Patent No.: US 8,708,743 B2
(45) Date of Patent: Apr. 29, 2014

(54) SHIELD FOR AN ELECTRICAL CONNECTOR HAVING STAR-SHAPED OPENINGS

(75) Inventors: Daniel González Perello, Terrassa (ES); David Soriano Fosas, Terrassa (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 12 days.

(21) Appl. No.: 13/485,456

(22) Filed: May 31, 2012

(65) Prior Publication Data

US 2013/0323972 A1 Dec. 5, 2013

(51) Int. Cl.
*H01R 13/648* (2006.01)

(52) U.S. Cl.
USPC ..... 439/607.23

(58) Field of Classification Search
USPC ..... 439/607.01–607.31
See application file for complete search history.

(56) References Cited

U.S. PATENT DOCUMENTS

| | | | | |
|---|---|---|---|---|
| 5,256,085 | A | 10/1993 | Tan et al. | |
| 5,603,639 | A * | 2/1997 | Lai et al. | 439/607.31 |
| 5,709,569 | A * | 1/1998 | Buck et al. | 439/607.01 |
| 5,772,471 | A * | 6/1998 | Buck | 439/607.28 |
| 6,050,852 | A * | 4/2000 | Wu | 439/607.02 |
| 6,206,728 | B1 * | 3/2001 | Krehbiel et al. | 439/607.28 |
| 6,206,730 | B1 | 3/2001 | Avery et al. | |
| 6,287,147 | B1 * | 9/2001 | Lin | 439/607.27 |
| 6,733,310 | B2 | 5/2004 | Fujikura et al. | |
| 6,942,509 | B2 | 9/2005 | Sasame et al. | |
| 6,954,363 | B2 | 10/2005 | Fan | |
| 7,044,783 | B2 | 5/2006 | Fan | |
| 7,361,966 | B2 | 4/2008 | Young et al. | |
| 7,637,671 | B2 | 12/2009 | Schempp | |

FOREIGN PATENT DOCUMENTS

JP 2010114110 A 5/2010

* cited by examiner

*Primary Examiner* — Chandrika Prasad

(57) ABSTRACT

A shield for an electrical connector comprises a conductive housing configured to enclose an exposed portion of at least one electrical connector. The shield further comprises at least one opening formed in the conductive housing configured to allow a corresponding mating portion of each of the at least one electrical connectors to be exposed. The shield further comprises and a plurality of conductive points located along at least one circumferential path within the conductive housing remote from the at least one opening.

18 Claims, 4 Drawing Sheets

SHIELD FOR AN ELECTRICAL CONNECTOR HAVING STAR-SHAPED OPENINGS

BACKGROUND

Electrical devices such as, for example, print heads demand, day by day, more data to be interchanged whilst consuming less power. This implies high speed electrical signals at lower voltages. However, components which operate at such high speeds and lower voltages are particular sensitive to electrostatic discharge and therefore, it is more difficult to protect these devices from electrostatic discharges using conventional methods without affecting the quality of the electrical signal. This is especially critical when the device has to be manipulated by the user. This is the case of user replaceable ink-jet print heads, for example a thermal ink-jet print head and piezo print heads. In allowing manual replacement of print heads, the electric connector of the print head is exposed to the risk of electrostatic discharge by the user that could damage the electronics to which the connector is connected.

One known technique is the use of electrostatic discharge filters to protect the data lines in order to protect their electronics from the eventual high voltage discharges. However, this technique adds additional components in the data lines which causes additional disruptions in the data lines and can limit the amount of data that can be transmitted through each line. Another solution is disclosed by U.S. Pat. No. 526,085 in which the edge of a shield around an electric conductor is serrated. However, this provides a large area over which the electrostatic discharge may be diffused which is in close proximity to the electric connector and may be inadequate in discharging the electrostatic away from the electric connector. Further, the serrated edge makes regular use of the connector difficult as the user may be harmed by the serrated edge.

BRIEF DESCRIPTION OF DRAWINGS

For a more complete understanding, reference is now made to the following description taken in conjunction with the accompanying drawings in which.

DETAILED DESCRIPTION

Figure 1:
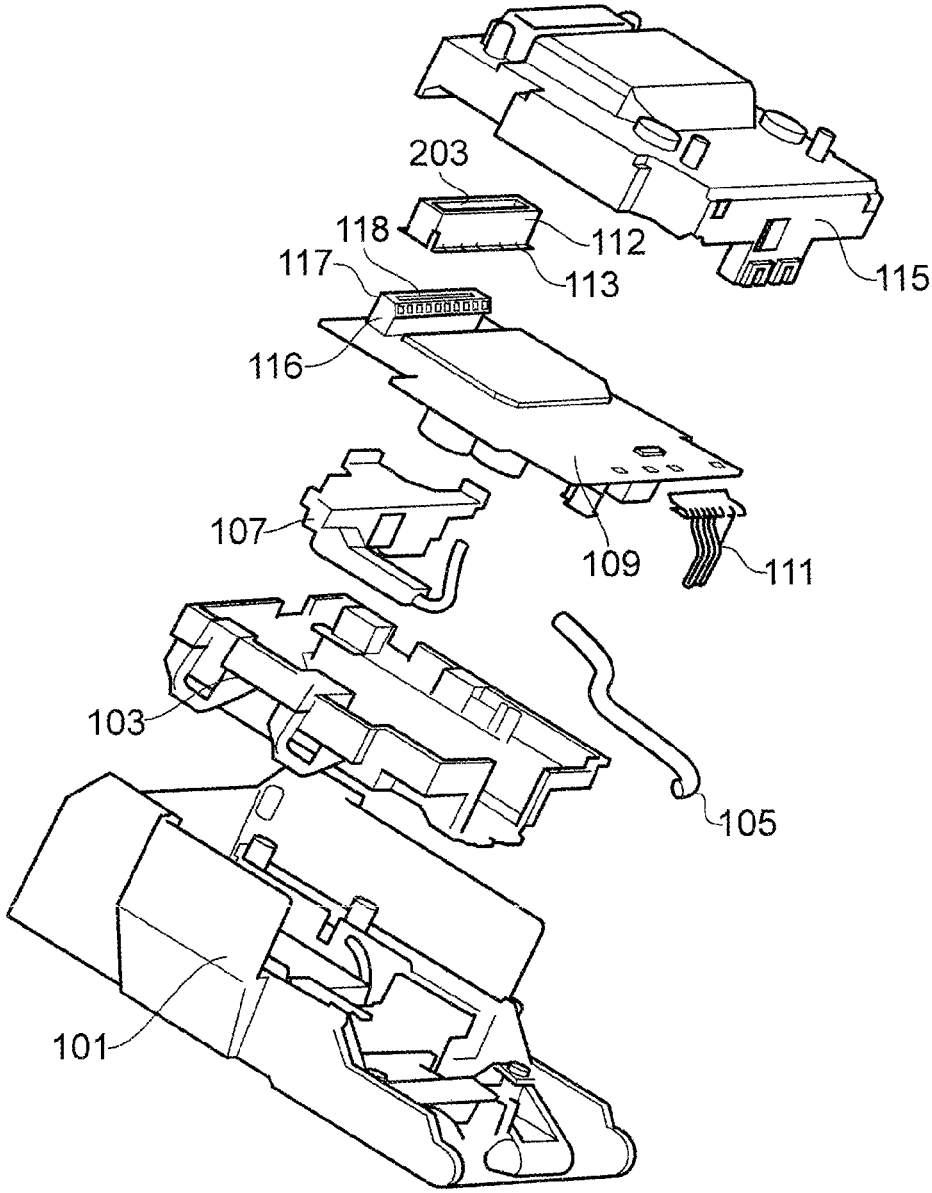
FIG. 1 is a simplified diagram of an assembly of a printer electronics including an example of an electric connector.

With reference to FIG. 1, an example of an electric connector 117 is illustrated. The electric connector may be a PCIe connector or the like, mounted, for example, on a printed circuit board 109 such that the connector 117 has an exposed portion 116 extending from the surface of the printed circuit board 109. The printed circuit board 109 is protected by a cover 115 which has a corresponding opening to allow a mating portion 118 of the connector 117 to be exposed. The printed circuit board is connected to a grounding contact 111.

The connector may be for use in a print head such that the printed circuit board 109 rests on a support 103 in which is housed a print head primer pump 107 and its corresponding controller cable 105. The printed circuit board support 103 is mounted in a housing 101. Although the connector 117 has been illustrated with respect to a print head, it can be appreciated that the connector may be equally applicable to other devices in which it is desirable to reduce electrical discharge, such as electrostatic discharge, in particular during user manipulation of the connector.

A shield 113 for the electrical connector 117 is provided. The shield 113 comprises a conductive housing 112. The conductive housing 112 may be formed, for example, of sheet metal folded to form the housing to enclose the exposed portion 116 of the electrical connector 117. It can be appreciated that, although only one connector and corresponding shield is shown in FIG. 1, the assembly may include a number of electric connectors housed in a single shield or a plurality of connectors each having separate, respective shields. The shield may be formed so as to be fixed to the surface of the printed circuit board.

Figure 2A:
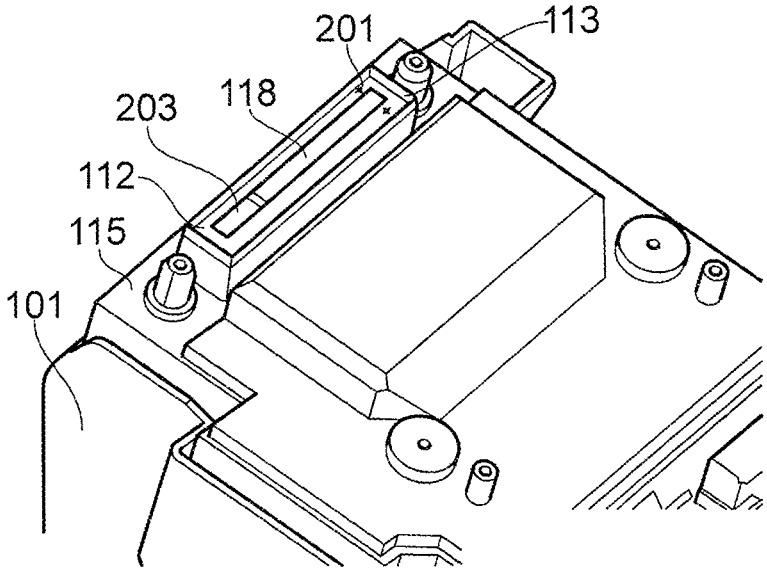
FIG. 2*a* is a perspective view of the electrical connector of FIG. 1.
Figure 2B:
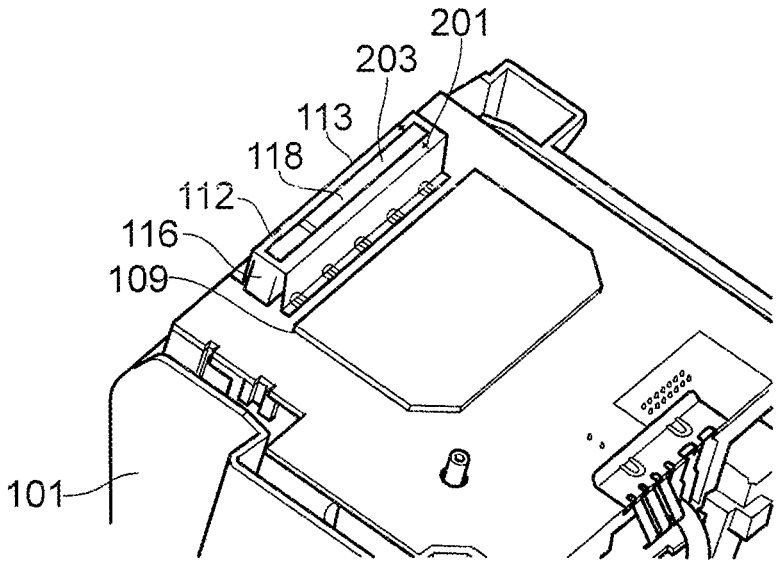
FIG. 2*b* is a perspective view of the electrical connector of FIG. 1 with the cover removed.

As shown in more detail in FIGS. 2*a* and 2*b*, the shield 117 further comprises an opening 203 formed in the conductive housing 112 configured to allow the mating portion 118 of the electrical connector 117 to be exposed. The opening 203 is located in an uppermost surface of the shield 113. The shield 113 further comprises at least one electrical discharge area 201 (or at least one second opening 201) located in an uppermost surface of the shield 113. The at least one second opening 201 captures electric discharge and may be located in proximity to the first opening 203. These discharge areas 201 may comprises a plurality of conductive points 421 (illustrated in FIG. 4) located along at least one circumferential path 423 within the conductive housing 112 remote from the first opening 203. The plurality of conductive points 421 may be located to extend inwardly into an area enclosed by the at least one circumferential path 423, each of the conductive points 421 lying on a second circumferential path 425.

The circumferential path 423 may be substantially circular. The second circumferential path 425 may be substantially circular and have a radius substantially less than the radius of the first circumferential path 423 so that the plurality of conductive points 421 are located in substantially close proximity to the centre of the circle defined by the first circumferential path 423. The centre of the first and the second circumferential paths 423, 425 may be substantially coincidental. The plurality of conductive points 421 may be substantially equal in size and/or substantially equally spaced along the first circumferential path 423. As illustrated, for example, in FIG. 4, there may be 4 conductive points 421 formed by stamping out a 4-pointed star opening 319 into the sheet metal of the shield 113. The conductive points 421 act as lightning conductors to drain any electrical discharge to the electrical ground as the discharge will preferentially strike the conductive points 421 on the sheet metal rather than the connector 117. The conductive points may be placed in substantially close proximity to the opening of the housing and hence the connector to maximise the capture of electrical discharge. The close arrangement of the conductive points 421 creates a high electrical field gradient improving the operation as a strike receptor and the remote location of the conductive points 421 from the opening 118 results in no sharp edges being presented to compromise user safety.

The shield 113 for the electrical connector 117 may be manufactured by forming a conductive sheet into a housing to enclose an exposed portion 116 of at least one electrical connector 117, for example, folding a sheet of conductive material into a shape to enclose the exposed portion 116 of at least one electrical connector 117. The conductive sheet may be cut to form at least one first opening 203 to allow a corresponding mating portion 118 of each of the at least one electrical connectors 117 to be exposed by stamping out the opening. The conductive sheet may be further cut (for example, by stamping a substantially star-shaped opening) to form at least one second opening 201 to form a plurality of conductive points 421 remote from the at least one first opening 203.

Figure 3:
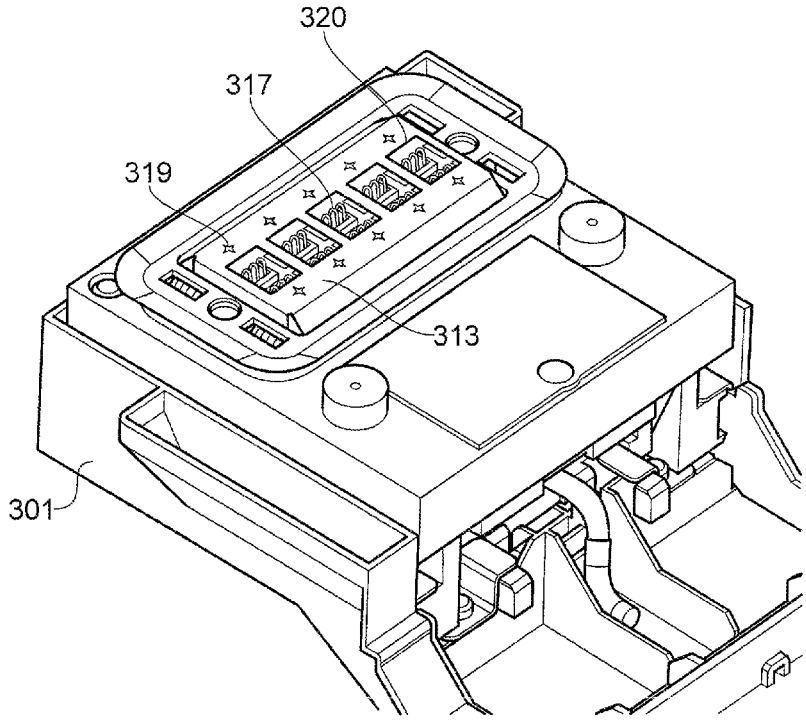
FIG. 3 is a perceptive view of another example of an electric connector.
Figure 4:
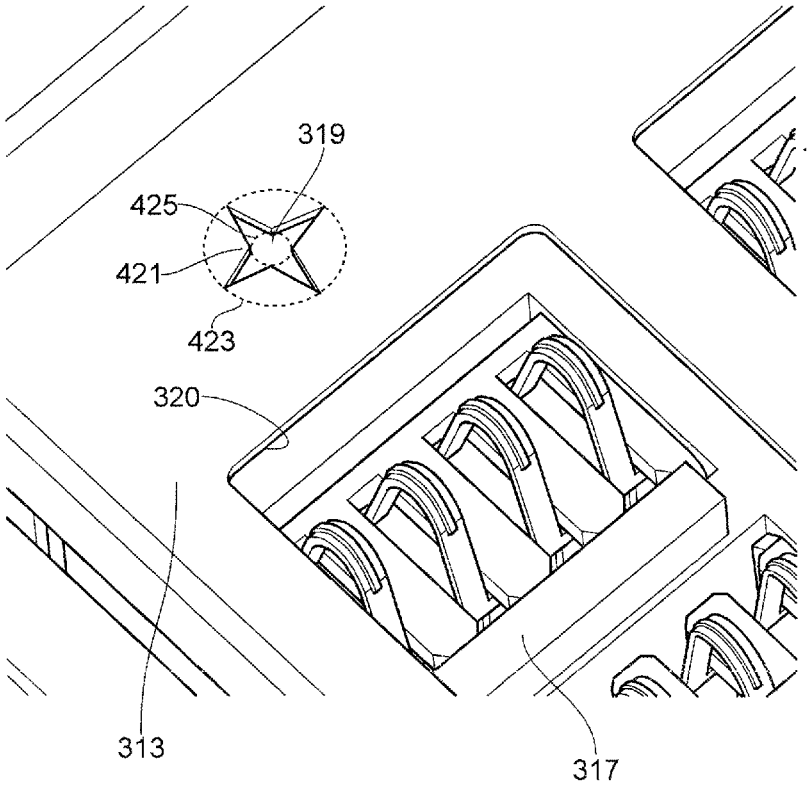
FIG. 4 is a partial view the detail of the shield of the electric connector of FIG. 3.

In alternative example, shown in FIGS. 3 and 4, an electrical connector 317 comprising a plurality of cantilever connectors is illustrated. The shield 313 houses the plurality of cantilever connectors 317. A plurality of first openings 320 are provided in the shield to expose the mating portion of each of the plurality of cantilever connectors 317. A plurality of conductive points are provided along a plurality of circumferential paths. These may be formed by stamping a plurality of star-shaped second openings 319 in the shield 313. Each of the plurality of circumferential paths is located in the proximity of one of the plurality of first opening such that there is located at least one second opening 319 in the proximity of each of the first openings 320. The conductive points provide a good strike capturing mechanism for each of the cantilever connectors 317.

As a result of the shield aforementioned, there is no need to use ESD filters on the electrical signals, thus minimizing the disruptions between the emitter and the receiver thus allowing higher speed signals through the same line, which at the same time allows sending the same amount of data whilst utilising fewer lines.

Although examples have been illustrated in the accompanying drawings and described in the foregoing detailed description, it will be understood that the invention is not limited to the examples disclosed, but is capable of numerous modifications without departing from the scope of the invention as set out in the following claims.

The invention claimed is:

1. A shield for an electrical connector, the shield comprising:

a conductive housing to enclose an exposed portion of at least one electrical connector;

at least one first opening formed in the conductive housing to allow a corresponding mating portion of each of the at least one electrical connector to be exposed; and at least one second opening having a shape of a star formed in the conductive housing, wherein the at least one second opening forms a plurality of conductive points pointing to a circumferential path within the conductive housing remote from the at least one first opening.

2. A shield according to claim 1, wherein the plurality of conductive points are located to extend inwardly into an area enclosed by the circumferential path.

3. A shield according to claim 1, wherein the circumferential path is substantially circular.

4. A shield according to claim 1, wherein the shape of the at least one second opening is a four-pointed star.

5. A shield according to claim 1, wherein the plurality of conductive points are located along the circumferential path within the conductive housing remote from, and in substantially close proximity to, the at least one first opening.

6. A shield according to claim 1, wherein the plurality of conductive points are substantially equally spaced along the circumferential path.

7. A shield for a plurality of electrical connectors, the shield comprising:

a conductive housing to enclose an exposed portion of the plurality of electrical connectors;

a plurality of first openings formed in the conductive housing to allow a corresponding mating portion of each of the plurality of electrical connectors to be exposed; and a plurality of second openings in the conductive housing, wherein each of the plurality of second openings has a shape of a star to form a plurality of conductive points pointing to a circumferential path within the conductive housing remote from the plurality of first openings and each of the plurality of second openings is located in substantially close proximity to a respective first opening.

8. A shield according to claim 7, wherein the plurality of conductive points of each of the plurality of second openings are located to extend inwardly into an area enclosed by the circumferential path.

9. A shield according to claim 7, wherein the circumferential path is substantially circular.

10. A shield according to claim 7, wherein the shape of each of the plurality of second openings is a four-pointed star.

11. A shield according to claim 7, wherein the plurality of conductive points are substantially equally spaced along the circumferential path.

12. A shield for an electrical connector, the shield comprising:

a conductive housing to enclose an exposed portion of at least one electrical connector;

at least one first opening formed in the conductive housing to allow a corresponding mating portion of each of the at least one electrical connector to be exposed; and at least one second opening having a shape of a star formed in the conductive housing for capturing electrical discharge.

13. A shield according to claim 12, wherein the shape of the star of the at least one second opening forms a plurality of conductive points pointing to a circumferential path.

14. A shield according to claim 12, wherein the shape of the at least one second opening is a four-pointed star.

15. A shield according to claim 12, wherein the at least one second opening is located in proximity to the at least one first opening.

16. An electrical connector comprising:

an exposed portion extending outwardly;

at least one mating portion located within the exposed portion; and a shield comprising:

a conductive housing to enclose the exposed portion of the electrical connector;

a first opening formed in the conductive housing to allow the at least one mating portion of the electrical connector to be exposed; and a second opening having a shape of a star formed in the conductive housing, wherein the second opening forms a plurality of conductive points pointing to a circumferential path within the conductive housing remote from the first opening.

17. An electrical connector comprising:

an exposed portion extending outwardly;

at least one mating portion located within the exposed portion; and a shield comprising:

a conductive housing to enclose the exposed portion of the electrical connector;

at least one first opening formed in the conductive housing to allow the at least one mating portion of the electrical connector to be exposed; and at least one second opening having a shape of a star formed in the conductive housing for capturing electrical discharge.

18. A print head comprising:

a printed circuit board, the printing circuit board comprising at least one electric connector, the at least one electric connector comprising an exposed portion extending outwardly from the circuit board, at least one mating portion located within the exposed portion, and a shield, wherein the shield comprises a conductive housing to enclose the exposed portion of the electrical connector;

a first opening formed in the conductive housing to allow the at least one mating portion of the electrical connector to be exposed; and a second opening having a shape of a star formed in the conductive housing, wherein the second opening forms a plurality of conductive points pointing to a circumferential path within the conductive housing remote from the first opening.

* * * * *